United States Patent [19]

Mattson

[11] 4,209,146

[45] Jun. 24, 1980

[54] DEVICE FOR EXTENSIBLE FIN BLADE ON SHELL OR THE LIKE

[75] Inventor: Kjell Mattson, Karlskoga, Sweden

[73] Assignee: Aktiebolaget Bofors, Bofors, Sweden

[21] Appl. No.: 876,089

[22] Filed: Feb. 8, 1978

[30] Foreign Application Priority Data

Feb. 9, 1977 [SE] Sweden ..... 7701405

[51] Int. Cl.[2] ..... F42B 13/32; F42B 15/16

[52] U.S. Cl. ..... 244/3.27

[58] Field of Search ..... 244/3.27, 3.28

[56] References Cited

U.S. PATENT DOCUMENTS 2,959,143 11/1960 Endrezze ..... 244/3.27

FOREIGN PATENT DOCUMENTS 147200 10/1954 Sweden ..... 244/3.27

594514 11/1947 United Kingdom ..... 244/3.27

*Primary Examiner*—David H. Brown

*Attorney, Agent, or Firm*—Pollock, Vande Sande & Priddy

[57] ABSTRACT

An extensible fin assembly for attachment with the tail section of a gas propelled projectile and the like, wherein a plurality of similarly shaped, hollow fin members are positioned about the periphery of the tail section, with each hollow fin member having a fin blade mounted in a slot formed in the fin member for pivoting between retracted and extended positions relative to the respective fin members.

9 Claims, 4 Drawing Figures

DEVICE FOR EXTENSIBLE FIN BLADE ON SHELL OR THE LIKE

BACKGROUND OF THE INVENTION

The present invention relates to a device for an extensible fin blade on a unit in the form of a shell, projectile, missile etc.

The invention is intended, inter alia, for use on fin-stabilized shells which are provided with a number of main fins, which are arranged with full-calibre dimensions so that they will be guided in the bore of the barrel when the shell is fired. In certain connections, for instance in the case of supersonic shells, for stabilization reasons and weight-reduction reasons, there is a desire to have the centre of pressure in the shell located as far to the rear in the shell as possible, without the length of the shell being increased substantially. A possibility of complying with this requirement is to make the fin arrangement extensible, so that parts of the fins exceed the full calibre after the shell has been fired from the barrel in question.

The present invention is directed towards this fact, which is known in itself, and proposes a specific arrangement of fins in which the respective main fin should be made with a recess in which the fin blade in question is supported so that it is movable from a retracted first position to an extended second position. In further developments of the concept of the invention it is also proposed how the extension function should be achieved and the second position be made distinct.

OBJECTS OF THE PRESENT INVENTION

An object that can mainly be considered to be characteristic for a device according to the invention is that the fin blade is supported in a recess in each main fin, wherein the fin blade is movable from a retracted first position to an extended second position.

BRIEF DESCRIPTION OF THE DRAWINGS

A preferred embodiment of the present invention will be described in the following, with reference to the accompanying drawings, in which.

DETAILED DESCRIPTION OF THE PREFERRED EMBODIMENT

Figure 1:
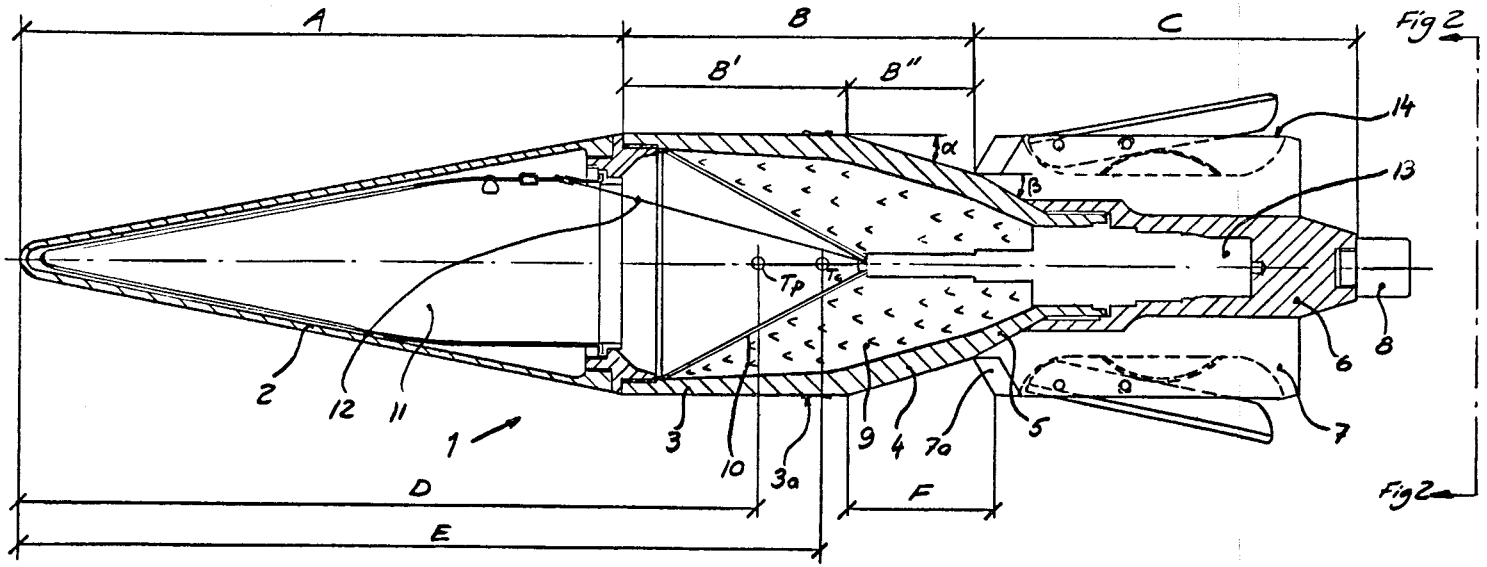
FIG. 1 shows a longitudinal section of a high-explosive shell utilizing the present invention.

FIG. 1 is intended to illustrate a high-explosive shell 1 designed for so-called hollow-charge effect, which is known in itself. The shell according to the example of the embodiment is moreover intended to constitute a supersonic shell. Within the scope of the invention, the shell can, of course, also be utilized for lower flight speeds.

In accordance with FIG. 1, the shell is made with a nose section 2, which externally has the form of an elongate conical part. The shell also comprises a middle section which consists of a straight distinct guidance part 3, which thus externally has the form of a cylinder, and also a short tapered part 4 which externally has the form of a first truncated cone. The guidance part 3 has its junction with the tapered part via an angle $\alpha$ which in this connection is considered to be a large angle and which forms the so-called relief angle. Finally, the shell has a tail section which is formed by a junction part 5 and a unit with a centre part 6, and arranged on this main fins protruding straight upwards and extending in the longitudinal direction of the shell. The junction part 5 is connected to said tapered part 4 at its one end, where it essentially has the form of a second truncated cone, the cone angle $\beta$ of which is greater than the cone angle $\alpha$ of said first truncated cone. At its other end, the junction part 5 is joined to a cylindrical part on to which said unit can be screwed via threads. Said fin 7 extends somewhat past the centre part 6 counted in the forwards direction, and undersurfaces of the sections extending past on the fins in the position when applied to the cylindrical part of the junction part of the unit will be in contact with the envelope surface of said second truncated cone. At their front ends, the fins have chamfered surfaces 7*a*. The centre part 6 of the unit is substantially of uniform thickness, apart from a slight widening at the portion which coacts with the cylindrical part in the tail section. At the rear, behind the fins 7, the centre part is conical, and at an end surface of this conical part the centre part supports a tracer 8, which is known in itself, and which is arranged so that it can be screwed into the centre part.

In FIG. 1, among other things, the lengths of the various sections of the shell have been indicated. Thus, the length of the nose section is indicated by A, the length of the middle part by B and the length of the guidance part by C. On the middle part, the guidance part 3 has a length of B′ and a tapered part has a length of B″.

Internally, the shell comprises a space for a load 9 in the form of a main charge, a hollow charge 10 with the specific shape for the function of a hollow-charge effect, and a front contact housing 11, at the inner wall of which an impact contact, which is known in itself, in the form of a lead 12, is arranged. At the rear, the shell is made with a space 13 for a fuse for the main charge of the shell. The fuse can be of a type which is known in itself, which is prepared for activation at the firing from the firearm utilized, and which is activated by means of the impact device 12 so that the main charge is initiated. On said guidance part, a driving band 3*a* is also arranged. The driving band is intended to give the shell a certain rotation when it is fired from the barrel in question.

The material in the shell and its component parts can be of the kind which is conventional for ammunition of this kind. Through the design of the various parts of the shell and the material used, the centre of gravity Tp has been obtained at a distance from the point of the nose section indicated by D, while the centre of pressure Tc is located behind Tp at a distance from said point of E.

Figure 3:
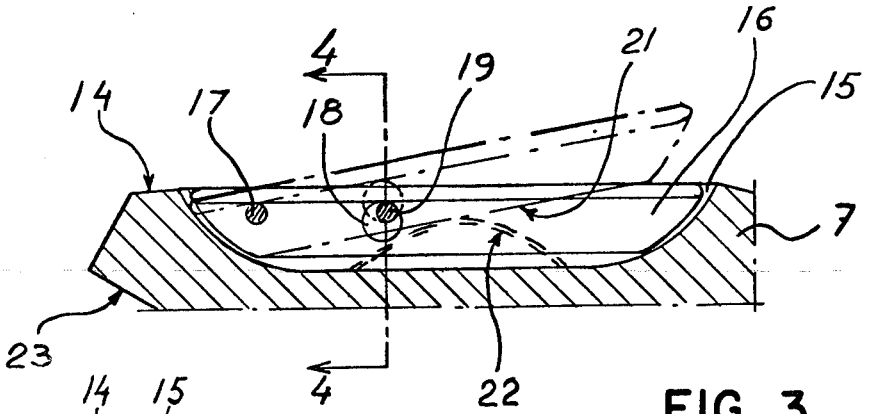
FIG. 3 shows a longitudinal section and enlargement of a fin arranged on the shell formed according to FIGS. 1 and 2.
Figure 4:
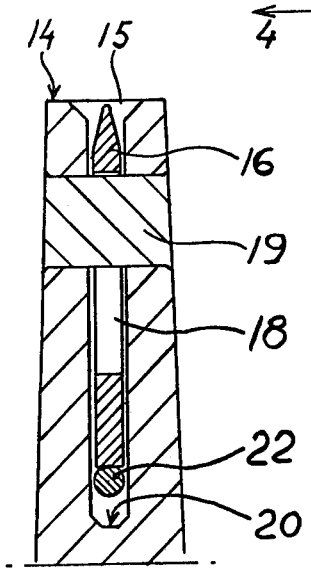
FIG. 4 shows a cross section of the fin according to FIG. 3.
Figure 2:
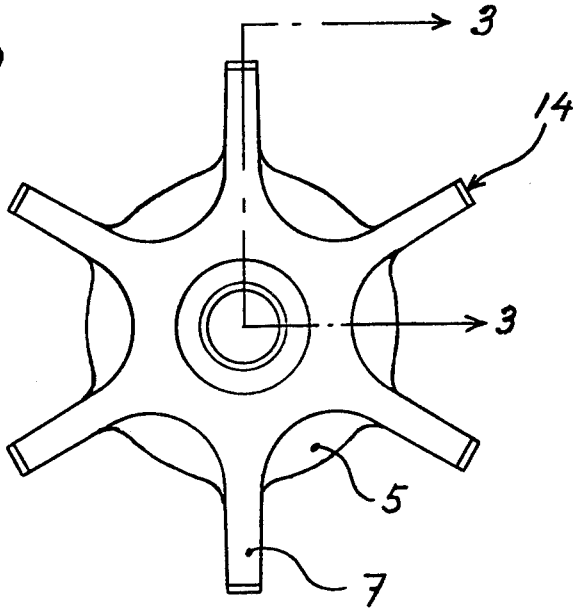
FIG. 2 shows an end view from the rear show the shell formed according to FIG. 1.

In accordance with FIG. 2, the unit 6 comprised in the tail section has main fins 7, equally spaced around the periphery. As shown in FIG. 3, each of these fins is made with a recess 15 or slot arranged from the upper edge 14 of the fin in the material of which the fin is made. In said recess a fin blade 16 (additional fin) is extensibly arranged, rotatably supported at its one end on a supporting pin 17 fastened to the walls of the recess, i.e. in the material of which the fin 7 is made. The fin blade 16 is moreover made with a through hole 18 somewhat to the rear of its middle parts.

An additional supporting pin 19 extends through said through hole, and the size of the hole exceeds the cross section of the pin 19. The degree of extension (the degree of turning out) of the fin blade 16 is thus determined by means of the hole 18 and the pin 19. In the recess 15 for the fin blade 16, between the bottom 20 of the recess and the lower edge side 21 of the fin blade a curved spring 22 is arranged, to permit the fin blade to be pressed down into the recess when the shell is in the barrel, and to achieve the pressing out of the fin blade to the extended position, which is indicated by dash lines in FIG. 3, and solid lines in FIG. 1, when the shell leaves the barrel. The fins 7 have a thickness of approx. 4 mm, while the fin 16 has a thickness of approx. 1 mm. The supporting pins 17 and 19 consist of metal rivets arranged in the fin 7 which extend over the recesses 15. In FIG. 3, the undersurfaces which can be in contact with the envelope surface of the second truncated cone are indicated by 23. The upper edges 14 of the fins 7 are straight, and correspond to the full calibre of the shell, while the surfaces of the extended fin blades 16 which protrude above the upper edges are located above the full calibre, which involves that the centre of pressure will be farther to the rear in the shell and, accordingly, that the centre of gravity can be moved rearwards to the corresponding degree in relation to the case without extensible fin blades.

The elongate fin blade 16 is fitted into the recess with comparatively good precision in relation to the walls of the recess. The total play between the width of the recess and the thickness of the fin blade is approx. 0.1 mm. The main fin and the extensible fin blade can be made of steel, plastic etc., which is conventional for the type of ammunition in question. The supporting pins can consist of rivets made of steel or plastic.

Through the design shown, the fin section 16 in the extended position will be located with approximately half of its side surfaces above the full-calibre dimension which, in accordance with the above, is represented by the dimension between two upper edge surfaces 14 of two diametrically opposite main fins. The sections of the extended fin sections on said diametrically opposite arranged main fins which are located highest above said edge surfaces 14 correspond to a dimension which is approx. 1.3 times the full calibre.

The fin section has a uniform height along the major portion of its longitudinal extent, and in the example of the embodiment has a height of approx. 12 mm, which should be set in relation to the calibre of the shell which is approx. 90 mm. The main fin has a height above the centre part 6 which is approx. 30 mm. The recess 15 or slot is somewhat deeper than the height of the fin blade, so that the space between a lower edge surface of the fin section and the bottom surface of the recess 15 for the curved spring 22 is obtained.

Said spring 22 consists of a bent wire spring which with its ends in contact with the bottom of the recess and with a section located between the ends coacts with said lower edge surface of the fin blade 16. The spring then has a spring action which involves that the fin blade 16 can lie pressed down into its first position during the firing from the barrel, without causing too hard wear of the barrel. At the same time, the spring, together with possible centrifugal force, is to achieve an extension and retaining of the fin blade to and in a distinct position which is determined by means of the through hole 18 and the pin 19. In the present example of the embodiment, which relates to a high-explosive shell with a comparatively low rotating speed, the spring 22 is to be arranged to retain the fin blade 16 in the extended position even at the lower rotation speeds occurring at the target. In the present case, the spring 22 is made of a spring material which in itself is conventional, such as steel, phosphorus bronze etc. and has a spring diameter of approx. 5 mm. The length of the spring is approx. 50 mm.

The recess 15, which extends down into the fin 7 substantially parallel to the outer walls of this has obliquely chamfered surfaces at the top, which are intended to facilitate the pressing in of the fin blade 16. In accordance with FIG. 3, at its lower edge, the recess is made with rounded corners. The fin blade is also provided with corresponding rounded corners. The supporting hole in the fin blade for the supporting pin 17 is located at the upper left-hand corner according to FIG. 3, and the through hole 18 is located at a distance from said upper left-hand corner which is approx. $\frac{1}{3}$ of the total length of the fin blade, which in the present case is approx. 185 mm. At the top, the fin blade is made with a straight, comparatively sharp edge, which has been achieved by having oblique side surfaces at the upper parts of the fin blade.

The invention is not limited to the embodiment shown above as an example, but can be subject to modifications within the scope of the accompanying claims.

I claim:

1. An extensible fin assembly for attachment with a tail section of a gas propelled projectile and the like in order to stabilize the flight of said projectile, and comprising:

at least one fin member extending in the longitudinal direction of said tail section of said projectile, with said fin member attached to and extending substantially perpendicularly from an outer surface of said tail section;

said fin member having an elongated slot extending into a middle portion of said fin member from an upper surface thereof, said fin member also having solid front and rear portions forming either end of said slot to protect said slot from forces generated by said gas propelled projectile during launching of said projectile;

a fin blade extending within said elongated slot in said fin member; and pivot means engaging said fin blade for pivoting movement between a retracted position wherein said fin blade is completely positioned within said slot and an extended position wherein a portion of said fin blade extends beyond said fin members.

2. An extensible fin assembly according to claim 1, wherein a plurality of said fin members are equally spaced about an outer periphery of said tail section, with each of said fin members having a fin blade positioned in an elongated slot extending through a middle portion thereof;

and each of said fin members also including pivot means engaging and pivoting said respective fin blade between retracted and extended positions relative to said elongated slots.

3. An extensible fin assembly according to claim 1, wherein an entrance portion of said elongated slot joining said upper surface of said fin member includes obliquely chamfered surfaces.

4. An extensible fin assembly according to claim 1, wherein a plurality of said fin members are positioned about the periphery of said tail section, wherein pairs of said fin members are diametrically opposed from one another and the linear distance from a radial outer edge of one fin member to a radial outer edge of an opposed fin member is equal to the full caliber of said projectile.

5. An extensible fin assembly acording to claim 1, wherein spring means is positioned between confronting end surfaces of said elongated slot and said fin blade for biasing said fin blade to said extended position.

6. An extensible fin assembly according to claim 5, wherein said spring means comprises an arched elongate spring compressed between a bottom surface of said fin blade and a bottom surface of said elongated slot, respectively.

7. An extensible fin assembly according to claim 1, wherein said elongated slot extends substantially parallel to a longitudinal axis extending through said tail section of said projectile.

8. An extensible fin assembly according to claim 7, wherein said pivot means comprises a first pin member extending through an end portion of said elongated slot and fixedly attached at either end to said fin member, said pivot means further comprises a first aperture formed in an end portion of said fin blade, with said aperture substantially corresponding in cross-section to said first pin member, wherein said first pin member extends through said first aperture to pivotally join said fin blade to said fin member at said respective end portions thereof.

9. An extensible fin assembly according to claim 8, wherein said pivot means further comprises a second pin member extending through said elongated slot and fixedly attached at either end to said fin member, with said second pin member extending through a middle portion of said elongated slot, said pivot means further comprises a second aperture formed in said fin blade, with said second aperture having a cross-section which substantially exceeds the cross-section of said second pin member, wherein said second pin member extends through said second aperture in said fin blade to limit the pivotal movement of said fin blade relative to said fin member.

* * * * *